US007625051B1

(12) United States Patent
Kim

(10) Patent No.: US 7,625,051 B1
(45) Date of Patent: Dec. 1, 2009

(54) DRAWER AND DRAWER SLIDE FACE-FRAME BRACKET ADJUSTER

(75) Inventor: Daniel S. Kim, Santa Fe Springs, CA (US)

(73) Assignee: Accuride International, Inc., Santa Fe Springs, CA (US)

( * ) Notice: Subject to any disclaimer, the term of this patent is extended or adjusted under 35 U.S.C. 154(b) by 0 days.

(21) Appl. No.: 11/350,188

(22) Filed: Feb. 7, 2006

Related U.S. Application Data

(63) Continuation of application No. 11/267,023, filed on Nov. 4, 2005, now abandoned.

(60) Provisional application No. 60/625,556, filed on Nov. 5, 2004.

(51) Int. Cl.
*A47B 88/00* (2006.01)

(52) U.S. Cl. ..... 312/334.5; 312/334.4; 312/334.27

(58) Field of Classification Search ..... 312/334.4, 312/334.5, 334.6, 334.7, 334.27, 334.32, 312/334.34, 334.1, 330.1; 248/220.1, 221.11, 248/225.11; 411/353
See application file for complete search history.

(56) References Cited

U.S. PATENT DOCUMENTS

| | | | | |
|---|---|---|---|---|
| 1,917,852 | A * | 7/1933 | Prez | 24/581.11 |
| 4,022,415 | A * | 5/1977 | Roderick et al. | 248/298.1 |
| 4,179,091 | A * | 12/1979 | Bidney | 248/265 |
| 4,278,309 | A * | 7/1981 | Dreiling | 312/334.27 |
| 4,744,107 | A * | 5/1988 | Fohl | 2/422 |
| 5,044,589 | A * | 9/1991 | Milne et al. | 248/265 |
| 5,275,483 | A | 1/1994 | Rasmussen | |
| 5,310,255 | A * | 5/1994 | Ranallo | 312/334.5 |
| 5,779,206 | A * | 7/1998 | Harris et al. | 248/214 |
| 6,233,790 | B1 * | 5/2001 | Carothers | 24/16 PB |
| 6,325,473 | B1 * | 12/2001 | Brustle et al. | 312/334.6 |
| 6,367,900 | B1 | 4/2002 | Woerner | |
| 6,390,576 | B1 | 5/2002 | Walburn | |
| 6,442,030 | B1 * | 8/2002 | Mammoser et al. | 248/917 |
| 6,694,567 | B1 * | 2/2004 | Domenig et al. | 16/238 |
| 6,749,277 | B2 * | 6/2004 | Michaels | 312/334.27 |
| 6,757,937 | B2 * | 7/2004 | Salice | 16/94 R |
| 6,854,817 | B1 * | 2/2005 | Simon | 312/334.6 |
| 7,207,762 | B2 * | 4/2007 | Teal | 411/526 |
| 2004/0104651 | A1 * | 6/2004 | Kreft et al. | 312/334.5 |
| 2005/0264146 | A1 * | 12/2005 | Fitz | 312/334.5 |
| 2005/0285493 | A1 * | 12/2005 | Hu et al. | 312/334.4 |

FOREIGN PATENT DOCUMENTS

| | | | | |
|---|---|---|---|---|
| DE | 3505939 | * | 8/1986 | 312/330.1 |

* cited by examiner

*Primary Examiner*—Hanh V Tran
(74) *Attorney, Agent, or Firm*—Christie, Parker & Hale, LLP.

(57) ABSTRACT

An adjustable mounting bracket is provided which includes an adjuster passing through an aperture of the bracket. The adjuster is moveable within the aperture, allowing an adjustment between the bracket and a cabinet member or a drawer member to which the adjuster is secured. Once properly adjusted, the bracket, which is coupled to a drawer slide or drawer panel, can be secured to the cabinet member or drawer member.

15 Claims, 9 Drawing Sheets

DRAWER AND DRAWER SLIDE FACE-FRAME BRACKET ADJUSTER

CROSS REFERENCE TO RELATED APPLICATIONS

The present application is a continuation of U.S. patent application Ser. No. 11/267,023, filed Nov. 4, 2005 now abandoned which claims the benefit of the filing date of Provisional Patent Application No. 60/625,556, filed Nov. 5, 2004, incorporated by reference herein.

BACKGROUND OF THE INVENTION

The invention relates generally to drawer slides, and more specifically to an adjustable mounting bracket for a drawer slide.

Drawer slides are commonly used to extendably couple drawers to cabinets. Drawer slides allow drawers to be extended from the cabinets and thereby allow easy access to the contents of the drawer. Drawer slides are commonly coupled to opposing sides of the drawer and the cabinet in which the drawer is placed, and are also commonly mounted to the bottom of a drawer and forward and rearward edges of the cabinet.

Some cabinets include a frame formed of beams and posts which provide support for a finished exterior of the cabinet, and also provide support and mounting points for drawer slides used within the cabinet. Other cabinets, sometimes referred to as face-frame cabinets, forego the use of many or all of the posts and beams, and instead use the frame of the cabinet itself to provide for stability of the cabinet as a whole.

The use of face-frame cabinets sometimes poses difficulty in mounting drawer slides to the cabinet. For drawer slides configured to mount underneath a drawer, drawer slides which are often referred to as undermount drawer slides, the rear of the cabinet often does not have a convenient beam to support the drawer slide. Moreover, positioning of the drawer slide often requires fine adjustment to the positioning of the drawer, and exact positioning, particularly of the rear of the drawer slide, may be difficult to accomplish with the drawer in the cabinet. Similar concerns apply to side-mounted drawer slides, particularly when it is desired to mount the side-mounted drawer slides to the rear of the cabinet in order to avoid marring visible side surfaces of the cabinet. Further, at times alignment of drawer fronts in a finished installation may also require adjustment.

SUMMARY OF THE INVENTION

The invention provides an adjustable drawer mounting bracket. In one aspect the invention provides an L-shaped mounting bracket with an adjustable mounting means. In some aspects of the invention the adjustable mounting means comprises a clamp adjustably gripping the mounting bracket, with the clamp configured to receive a screw or the like for affixing the clamp to the rear of a cabinet. In some embodiments the clamp is a clip which adjustably binds against the mounting bracket. In some embodiments the clip comprises an anchor with a post and a ring engaging the post in a binding fashion. In some embodiments the post and ring acting in a manner similar to a rivet. In many aspects the invention provides an anchor and ring gripping a plate of the mounting bracket. In further embodiments, the adjustable mounting bracket includes an offset platform for engaging a drawer slide member. In some aspects the adjustable mounting bracket is coupled to a drawer face. In some aspects the adjustable mounting bracket is coupled to a drawer slide.

In one aspect the invention the invention provides a drawer assembly comprising: a drawer slide assembly comprising a first slide member and a second slide member extendably coupled to one another; a bracket having an aperture passing therethrough, wherein the bracket is configured for coupling to the second slide member; and a clamp adjustably gripping the bracket about the aperture, wherein the clamp is configured for coupling to a wall of a cabinet.

In another aspect the invention provides a drawer assembly comprising: a drawer slide assembly comprising a first slide member and a second slide member extendably coupled to one another; a bracket having an aperture passing therethrough, wherein the bracket is configured for coupling to a drawer face; and a clamp adjustably gripping the bracket about the aperture, wherein the clamp is configured for coupling to a drawer panel.

In another aspect the invention provides a drawer slide assembly comprising: a drawer slide comprising a first slide member and a second slide member extendably coupled to one another; a bracket coupled to the first slide member of the drawer slide; and means for adjusting the position of the bracket relative to a cabinet.

In yet another aspect the invention provides a method for securing a drawer component to a cabinet component, comprising: coupling the drawer component to a bracket, wherein a clamp adjustably grips the bracket about an aperture, and is movable therein; securing the adjuster to the cabinet component; adjusting the bracket relative to the adjuster; and securing the bracket to the cabinet component.

These and other aspects of the invention are more fully comprehended on consideration of the following description in conjunction with the associated drawings.

DETAILED DESCRIPTION

Figure 1:
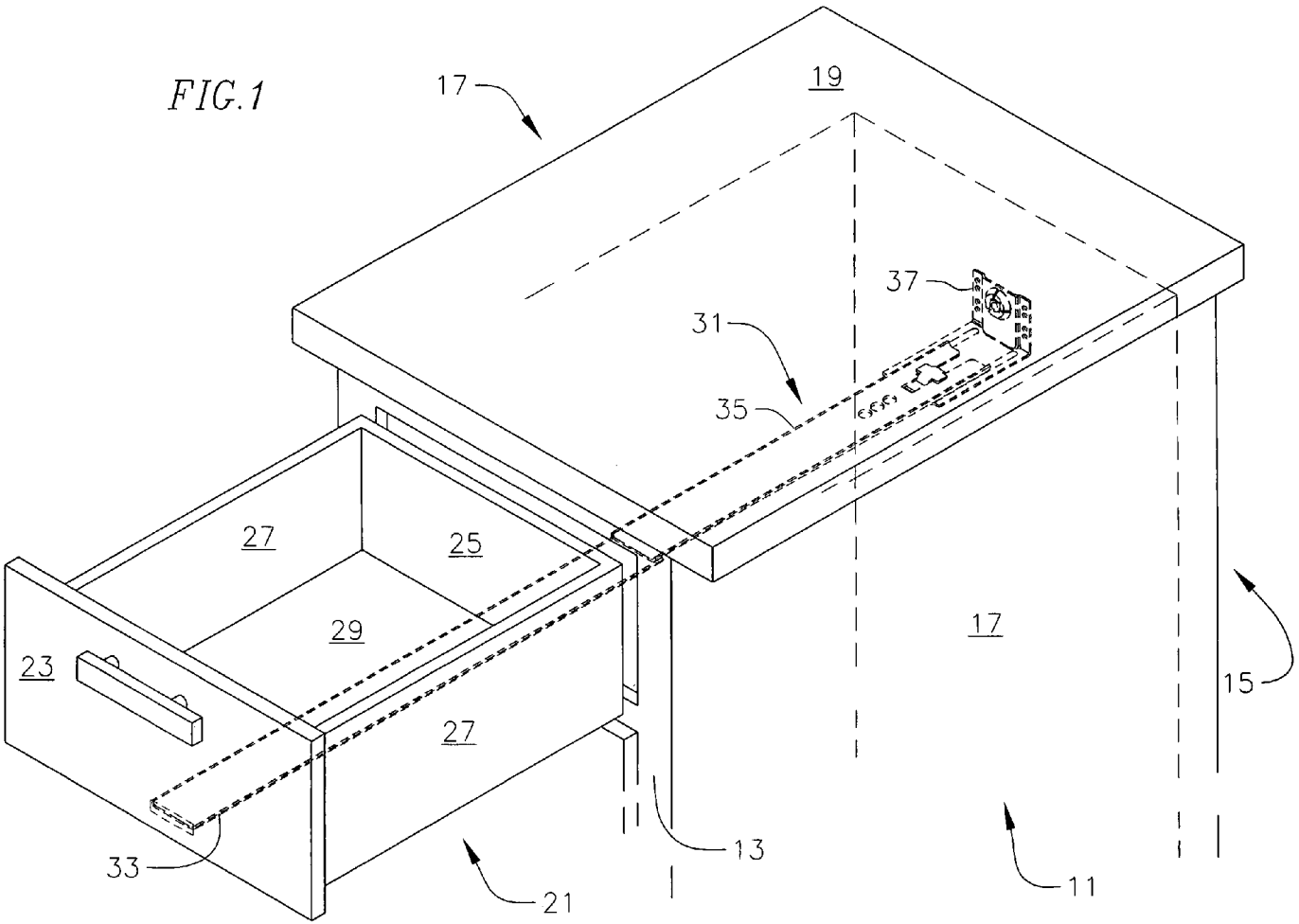
FIG. 1 illustrates a cabinet with a drawer extendably coupled to the cabinet by an undermount drawer slide attached to the cabinet with an adjustable mounting bracket in accordance with aspects of the invention.

FIG. 1 illustrates a cabinet 11 including an undermount drawer slide mounted with an adjustable mounting bracket in accordance with aspects of the invention. The cabinet includes a front face 13, a rear wall 15, side walls 17 and a top 19. The cabinet is of face frame construction, with the walls of the cabinet providing support for the cabinet as a whole.

Extendably mounted to the cabinet is a drawer 21. The drawer includes a front face 23 and a rear wall 25 interconnected by sidewalls 27, with a bottom 29 bounded by the front face, rear wall and sidewalls. Extension of the drawer from the cabinet allows for easy access to contents of the drawer through the open top of the drawer.

The drawer is extendably mounted to the cabinet by an undermount drawer slide 31. As illustrated only a single undermount drawer slide is used, although often a pair of undermount drawer slides on opposing margins of the bottom of a drawer are used. A drawer member 33 of the undermount drawer slide is mounted to the bottom of the drawer. In many instances the drawer member is mounted to a portion of the front face of the drawer extending below the bottom of the drawer. In other instances the drawer member is mounted directly to the bottom of the drawer. A cabinet member 35 of the undermount drawer slide 31 is mounted to the interior of the front face of the cabinet. An adjustable mounting bracket 37 coupled to the rear of the undermount drawer slide couples the cabinet member to the rear wall of the cabinet. The cabinet member and the drawer member are extendably coupled, often by bearings and sometimes including an intermediate member providing increased drawer slide extension.

Slight position changes of a drawer slide are often beneficial during installation. For example, often two drawer slides are used to couple a drawer to a cabinet, and it is generally important for the drawer slides to be parallel to each other and squarely aligned with the cabinet. This helps avoid binding of the slides during operation, and also allows the drawer to close properly. In addition, proper alignment of the front face of the drawer to the front face of the cabinet may require that the rear mounting position of the slide be properly positioned in the vertical and horizontal directions, so as to help avoid gaps between the drawer and the cabinet when the drawer is closed and to allow proper extension of the drawer from the cabinet. Due to inaccuracies in the construction of either the drawer or the cabinet, during installation, or even afterwards, slight positioning changes may also be beneficial to properly align the drawer in the cabinet.

Figure 2:
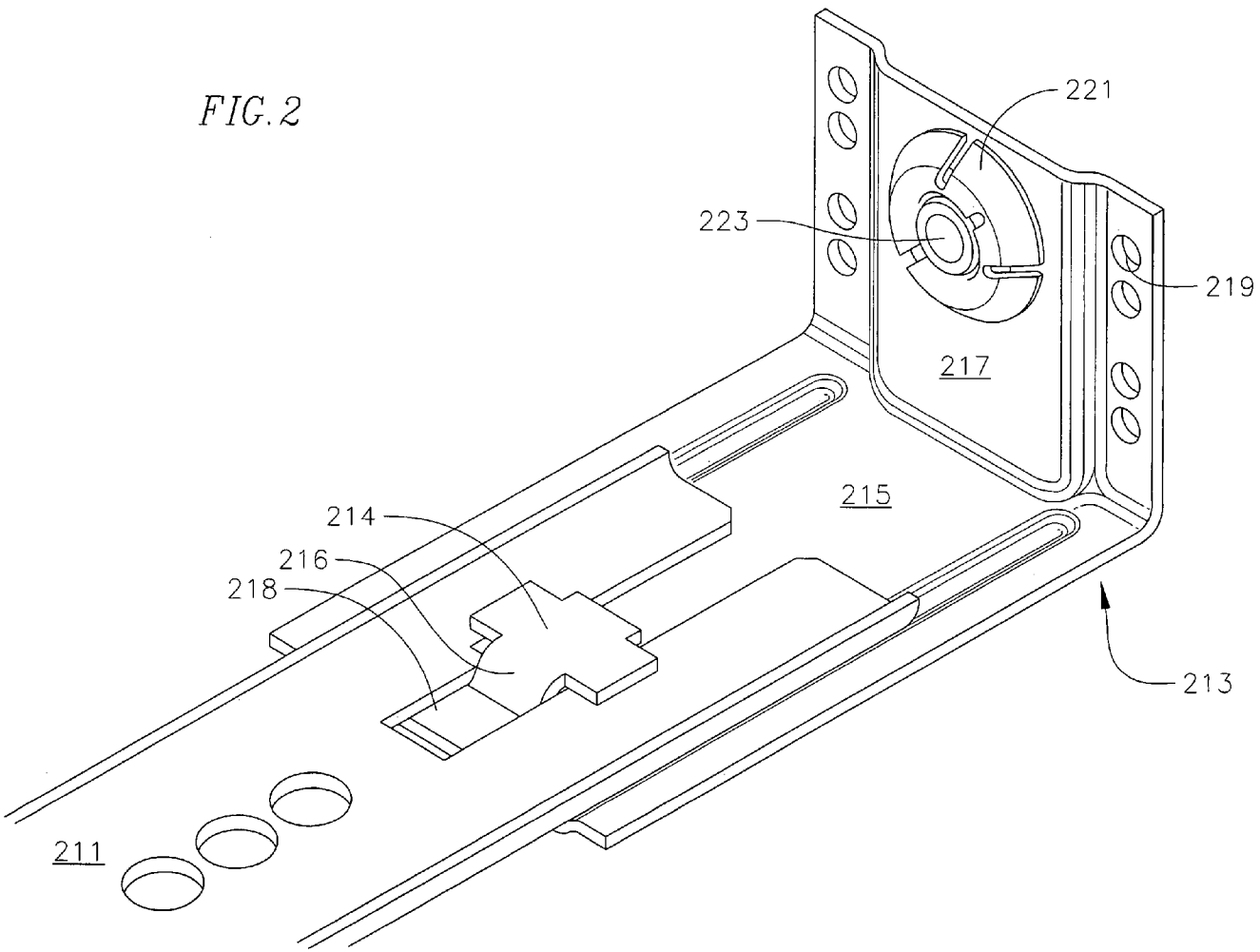
FIG. 2 illustrates an undermount drawer slide coupled to an adjustable mounting bracket in accordance with aspects of the invention.

Accordingly, a drawer slide with an adjustable mounting bracket in accordance with aspects of the invention is illustrated in FIG. 2. The drawer slide is an undermount drawer slide. The undermount drawer slide includes a cabinet member 211 configured for mounting to a cabinet, in part through use of the adjustable mounting bracket, and a drawer member (not shown in FIG. 2) configured for mounting to a drawer. Often interposed between the cabinet member and the drawer member is an intermediate member (not shown in FIG. 2). The drawer member is slidably coupled to the cabinet member by the intermediate member and bearings. Often, the cabinet member includes an L-bracket approximate a front of the drawer slide, with the L-bracket providing a bracket for mounting the front of the drawer slide to a sidewall of the cabinet. In other embodiments a T-bracket is provided at the front of the cabinet member, with the cabinet member being adapted for mounting to the front face of the cabinet. A T-bracket may be inset into the front of the outer member, such that the front of the drawer member may be coupled to the rear of the front face of the drawer. Alternatively, the drawer member may be mounted to the underside of the drawer.

Coupled to the rear of the drawer member is an L-bracket 213. The L-bracket includes a base 215 and a wall 217 extending roughly perpendicular to the base along an edge of the base. The base is coupled to the cabinet member 211 of the drawer slide. The base may be coupled to the cabinet member using rivets, slots in the base or the cabinet member, and other coupling methods or the like. As illustrated in FIG. 2, a raised platform 214 extends above the base, with a ramp 216, or connector, coupling the platform and the base. The raised platform may be considered a bayonet, and may be material punched out of the base. The cabinet member includes a slot 218 extending to the rear of the cabinet member, and the ramp is placed in the slot. The platform therefore rides above the portion of the cabinet member, with the base below and supporting the cabinet member. The platform prevents upward motion of the cabinet member, while the ramp prevents side-to-side motion.

The wall includes a plurality of screw holes 219 along margins of the second wall. The screw holes allow for passage of screw, pins, or the like for fixedly attaching the second wall to a rear wall of a cabinet.

Figure 3:
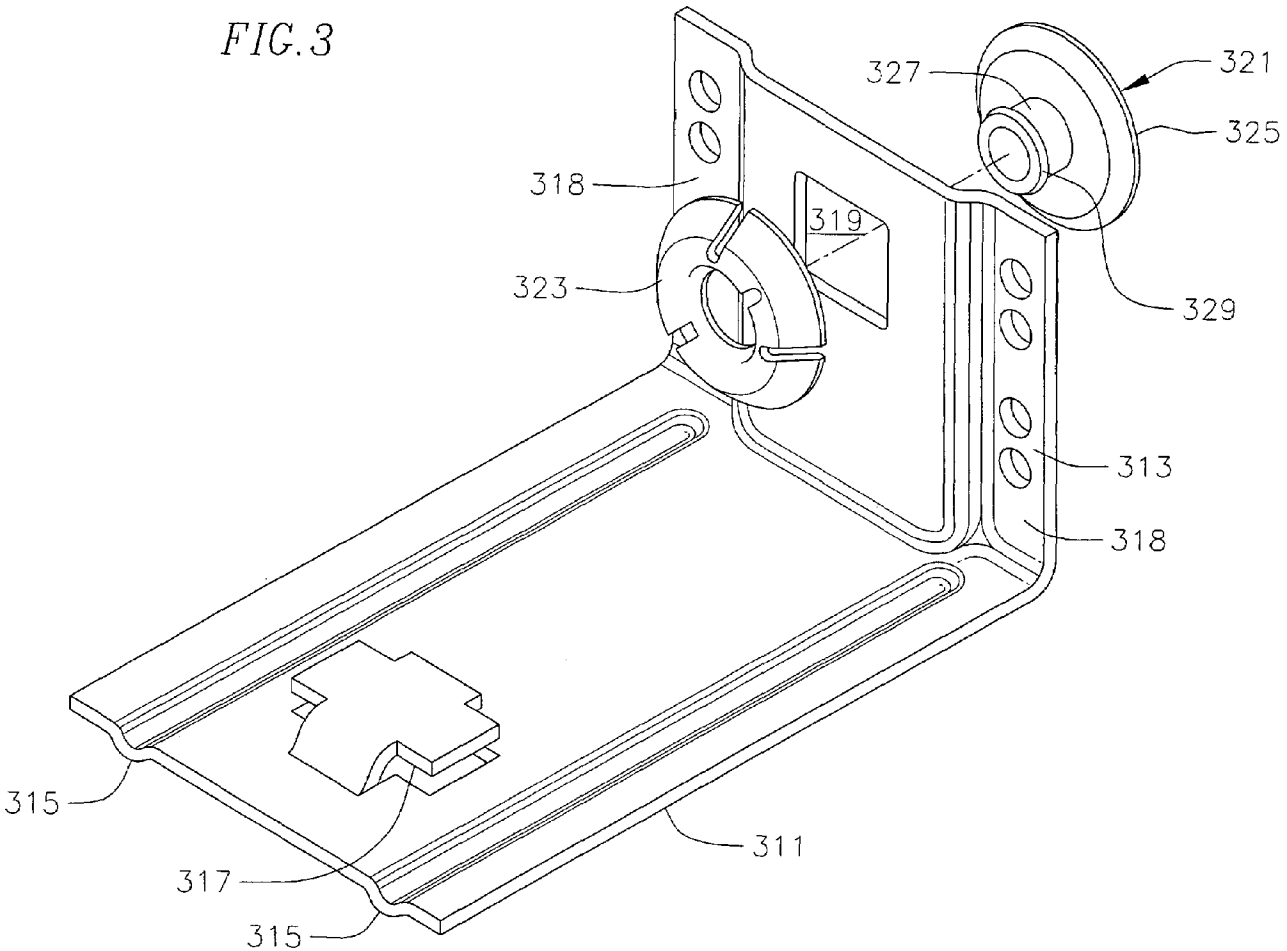
FIG. 3 illustrates a perspective view of an adjustable mounting bracket in accordance with aspects of the invention, showing a clamp of the adjustable mounting bracket in exploded view.

The wall also includes an aperture, or a window as shown in FIG. 3. In some embodiments the aperture may extend to one or more edges of the wall, and may also be considered a cut-out. An adjuster 221 (see FIG. 2), which is a clamp in embodiments, grips portions of the wall along edges of the window. The adjuster includes an aperture 223 therethrough to allow for passage of a screw or other item to hold the position of the adjuster with respect to the rear wall of a cabinet. The adjuster grips the edges of the window with sufficient force to largely maintain position of the drawer slide with respect to the cabinet under nominal loading conditions present during installation of the drawer slide. Application of force to the drawer slide, as part of the installation process, allows the adjuster to be repositioned in the window. This allows for desired positioning of the drawer slide during installation.

FIG. 3 illustrates a perspective view of an adjustable mounting bracket in accordance with aspects of the invention. As illustrated in FIG. 3, the adjustable mounting bracket includes an adjuster shown in an exploded view. The adjustable mounting bracket includes an L-shaped bracket. The L-shaped bracket includes a base 311 comprising a longitudinal sheet and a wall 313 extending from a longitudinal end of the base. The wall also comprises a sheet, and extends from the end of the longitudinal sheet at approximately 90 degrees. The base includes linear creases 315, or bends, towards longitudinal margins of the sheet. The creases serve to increase torsional strength of the base. An offset tang 317 is punched out of a forward edge of the sheet. The tang includes an offset portion and a mount portion. The mount portion has a greater width than the offset portion, allowing the offset portion to be placed, for example, in a U-shaped area of an undermount drawer slide, particularly of the cabinet member. More often, however, the tang is inserted into an aperture of a cabinet member of an undermount drawer slide. For example, in some embodiments the cabinet member includes a plate or a portion of a bracket extending away from the other slide member, and the plate or bracket includes an aperture or cut-out. The aperture or cut-out may include a large opening area for insertion of the tang, the aperture also narrower with including portion for receiving the offset portion of the tang while the mount portion of the tang rests about the aperture on the plate or bracket.

The wall includes a central portion and slightly offset portions 318 approximate margins of the wall. The offset portions, which can be considered offset parallel flanges, include apertures for passage of screws or the like (see also FIG. 2). The offset portions provide clearance space for placement of an object, such as a portion of the adjuster, between the wall and a rear wall of a cabinet to which the adjustable mounting bracket is attached.

The wall includes a central window 319. In other embodiments the central window is a cut-out that extends to edges of the wall. A clamp is configured at least partially within a window. As illustrated in FIG. 3, the clamp as shown in exploded view, with the clamp comprising an anchor 321 and a ring 323, which may be termed an adjuster clip. The anchor may be considered a male part of the clamp, with the ring the female part. The anchor includes a disk 325 with a post 327 extending from the disk. At the end of the post is a head 329 having a diameter greater than the post. The ring is annular in shape, with an inner diameter defining an opening and an outer diameter defining an outer edge of the ring. In operation the ring is positioned about the post, with the head maintaining the ring in position. Preferably the head holds the ring tightly against the wall of the mounting bracket, thereby frictionally maintaining position of the clamp and the mounting bracket. As illustrated, the post is substantially a hollow cylinder, such that the post may be diametrically deformed as the ring is placed over the post. In addition, as illustrated, and in many embodiments, the hollow post is centered on an aperture in the disk, allowing a fastening device such as a screw to be placed through the post and disk (see also FIG. 2). With the ring centered on the post, the body of the screw is also passed through the ring, allowing fastening of the anchor to the rear wall of a cabinet.

In some embodiments, the head of the screw presses against the ring, such that the ring presses against the wall of the mounting bracket. In some of such embodiments, the ring is used without the anchor.

Figure 4:
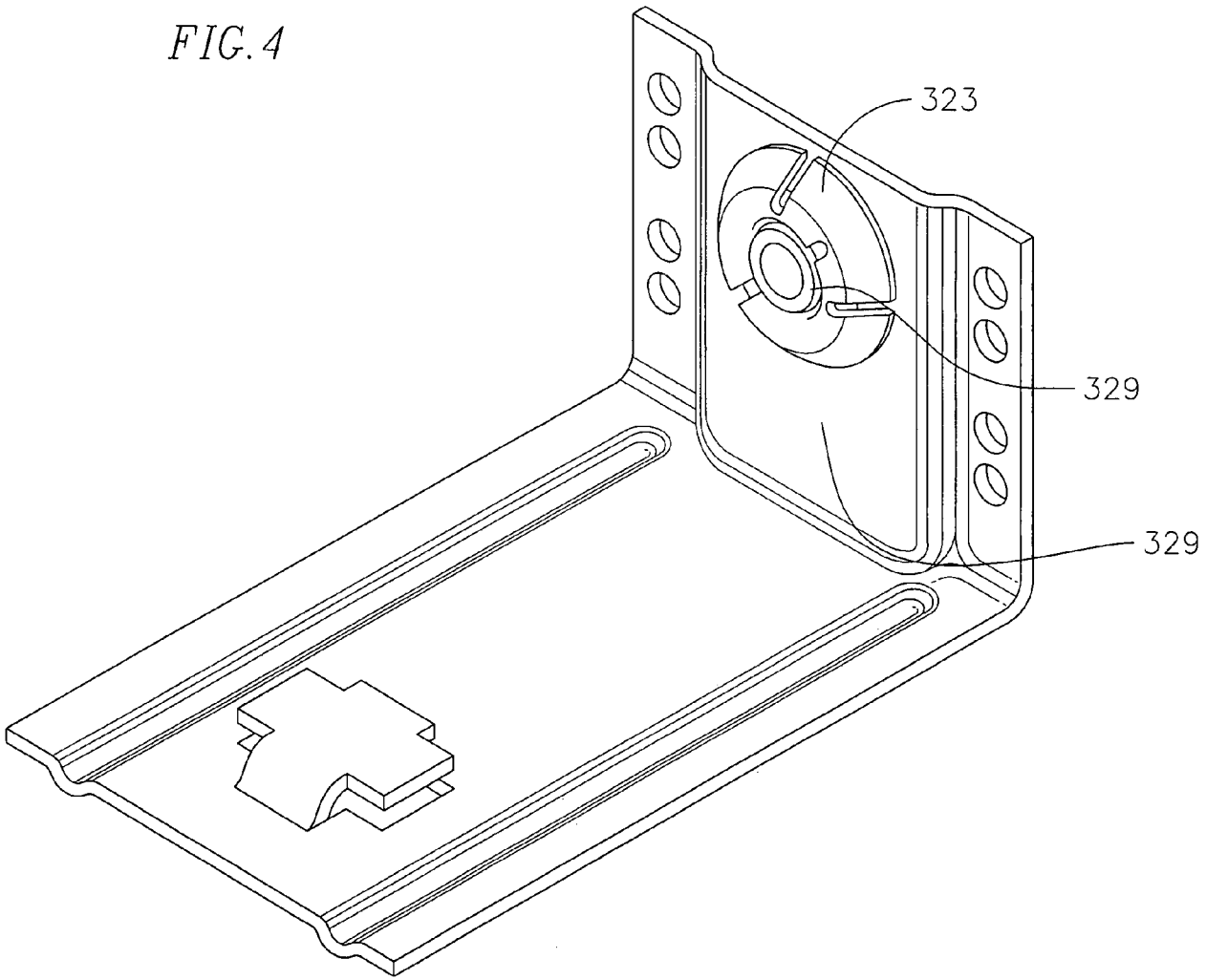
FIG. 4 illustrates a perspective view of the adjustable mounting bracket in accordance with aspects of the invention.

FIG. 4 illustrates a view of the adjustable mounting bracket of FIG. 3 with the clamp gripping portions of the wall of the adjustable mounting bracket. As may be seen in FIG. 4, the ring 323 is positioned about the post of the anchor 321 (see FIG. 3) with the head 329 of the post maintaining the ring in position with respect to the anchor.

Figure 5:
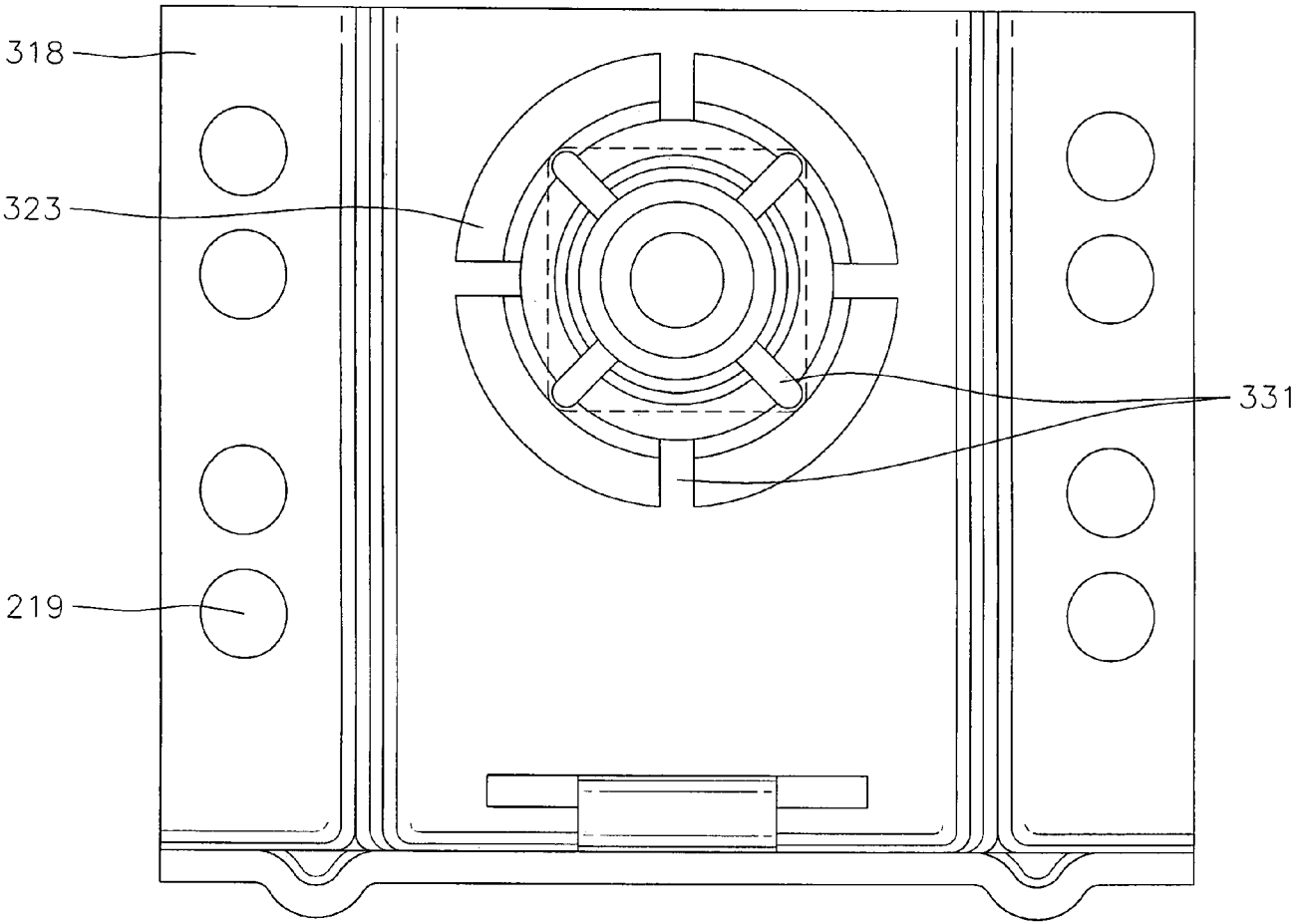
FIG. 5 illustrates a front view of an adjustable mounting bracket in accordance with aspects of the invention, and includes a semi-flow diagram of a method of using the adjustable mounting bracket to couple the mounting bracket to a cabinet.

FIG. 5 illustrates a view of an adjustable mounting bracket in accordance with aspects of the invention with a clamp centered within a window of a mounting bracket. In many embodiments, and as illustrated in FIG. 5, the adjustable mounting bracket is the adjustable mounting bracket of FIGS. 3 and 4. The adjustable mounting bracket includes a mounting bracket and a clamp centered within a window (seen in phantom view) of the mounting bracket. In some embodiments, and as illustrated, the ring 323 includes diametrical slots 331. The diametrical slots increase flexibility of the ring and allow for an increased frictional interface between the ring and the mounting bracket. As the ring is mounted to the rear wall of the cabinet, movement of the ring within the window also results in movement of the bracket and a drawer slide coupled to the bracket is achieved with respect to the cabinet.

The adjustable mounting bracket is coupled to a slide. A screw is placed through the clamp, sometimes called an adjuster, to couple the adjuster to the cabinet. The adjuster is gripably coupled to a mounting bracket. The adjuster is held in position with respect to the mounting bracket through frictional forces. These frictional forces may be overcome by application of force to the mounting bracket. In some embodiments the force is applied to the mounting bracket by a rotation of the ring. In some embodiments, for example, rotation of the ring results in relative movement for example when not all of the ring is necessarily in contact with the bracket. Generally, however, force is applied to the mounting bracket by applying force to an object (other than the ring) coupled to the mounting bracket, thereby resulting in a movement of the mounting bracket. For example, movement of a drawer slide coupled to the mounting bracket results in movement of the bracket. In many embodiments the mounting bracket is coupled to a drawer slide, which in turn is coupled to a drawer. Many times in such embodiments a preferred method of positioning the bracket is to simply shut the drawer, allowing movement of the drawer and drawer slide to properly position the mounting bracket.

The mounting bracket is fixed in place with respect to the cabinet by placing screws through the mounting holes 219 of the flanges 318.

Figure 6:
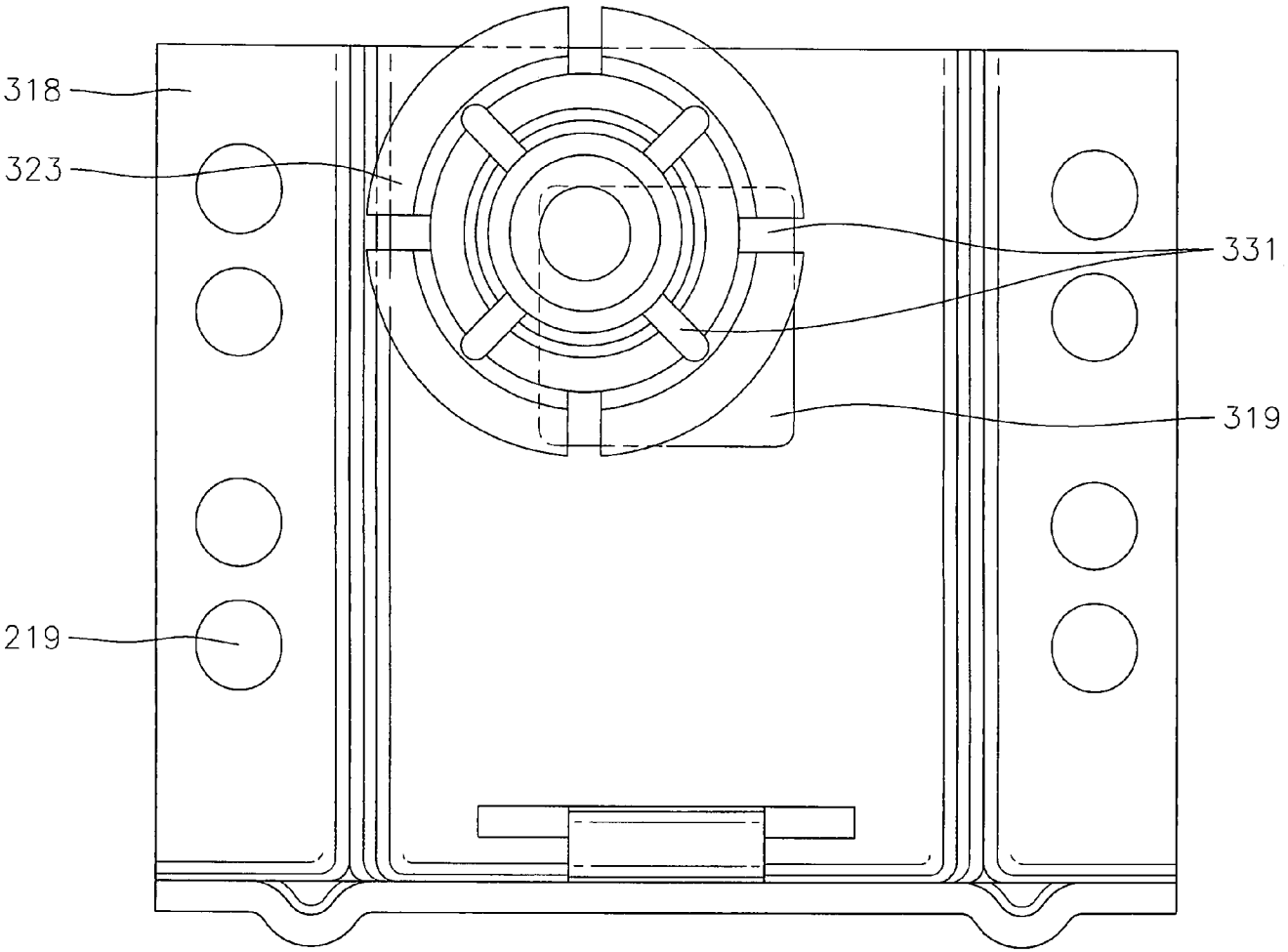
FIG. 6 illustrates a front view of an adjustable mounting bracket in accordance with aspects of the invention with an adjuster positioned in the upper most left hand corner of an adjustment window in the mounting bracket.

FIG. 6 additionally shows a front view of the adjustable mounting bracket in accordance with aspects of the invention. As illustrated in FIG. 6, the clamp is placed approximate an uppermost left hand corner of the adjustment window 319 in a wall of the mounting bracket.

Figure 7:
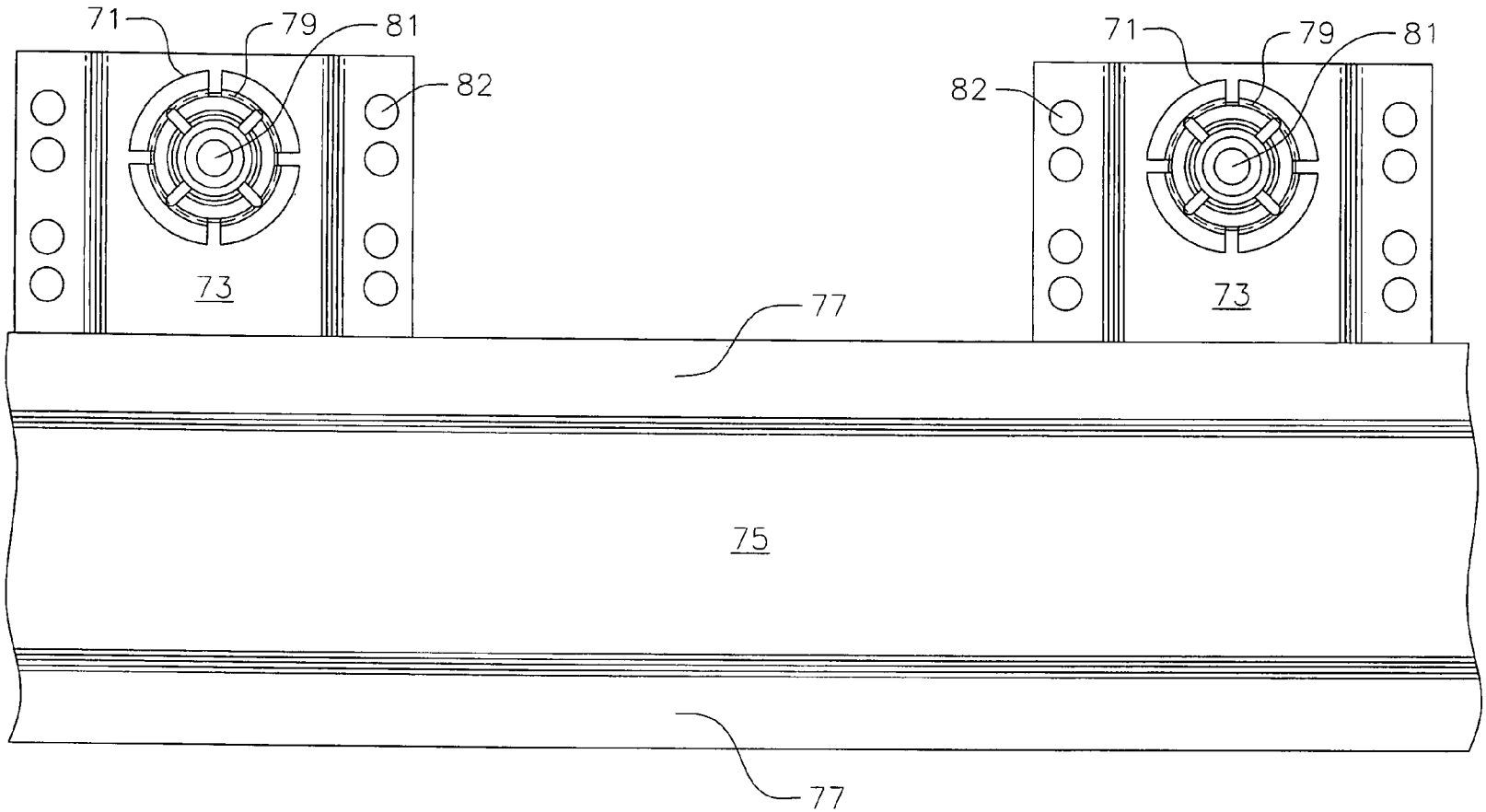
FIG. 7 illustrates a side view of a cabinet member of a side mount drawer slide with dual adjusters in accordance with aspects of the invention.

In some embodiments an adjuster in accordance with aspects of the invention is used with a side mounted drawer slide. FIG. 7 illustrates a side view of a pair of adjusters 71 on plates 73 coupled to a web 75 of an outer member, or cabinet member, of a side mounted drawer slide. As illustrated, the outer member is an outer member of a telescopic slide assembly. The outer member includes a longitudinal web with bearing raceways 77 about longitudinal margins of the web. A forward plate is coupled to the web towards a forward end of the web. A rear plate is coupled to the web approximate a rear portion of the web. In some embodiments the plate is welded, via spot welding or other welding methods, to the web. In other embodiments the plates are coupled to the web via bayonets and pockets or in other manners known to those with skill in the art. Each of the plates has an aperture 79 (shown in phantom view) in the plate. In the embodiment of FIG. 7, the aperture is in the form of a circle. In other embodiments the aperture may be square, hexagonal, or some other shape. In further embodiments the aperture may be a cut-out that extends to an edge of the plate.

A clamp, such as the anchor and ring clamp of previous figures, grips opposing faces of the plate. An aperture 81 that passes through a portion of the clamp provides for passage of a screw or the like for fixing the clamp, and therefore the plate and slide, to the side of a cabinet. The slide may then be repositioned with respect to the cabinet by applying force to the slide and/or plate to move the clamp within the aperture. Once the slide is appropriately positioned, screws are placed in additional screw holes 82 in the plate, with the screws holding the plate, and therefore the slide, in place with respect to the cabinet.

In some embodiments edges of the plate include offset flanges to provide clearance for an anchor portion of the clamp. In other embodiments clearance for the anchor portion of the clamp is provided by including ribs or other offset structures in the plate.

Figure 8:
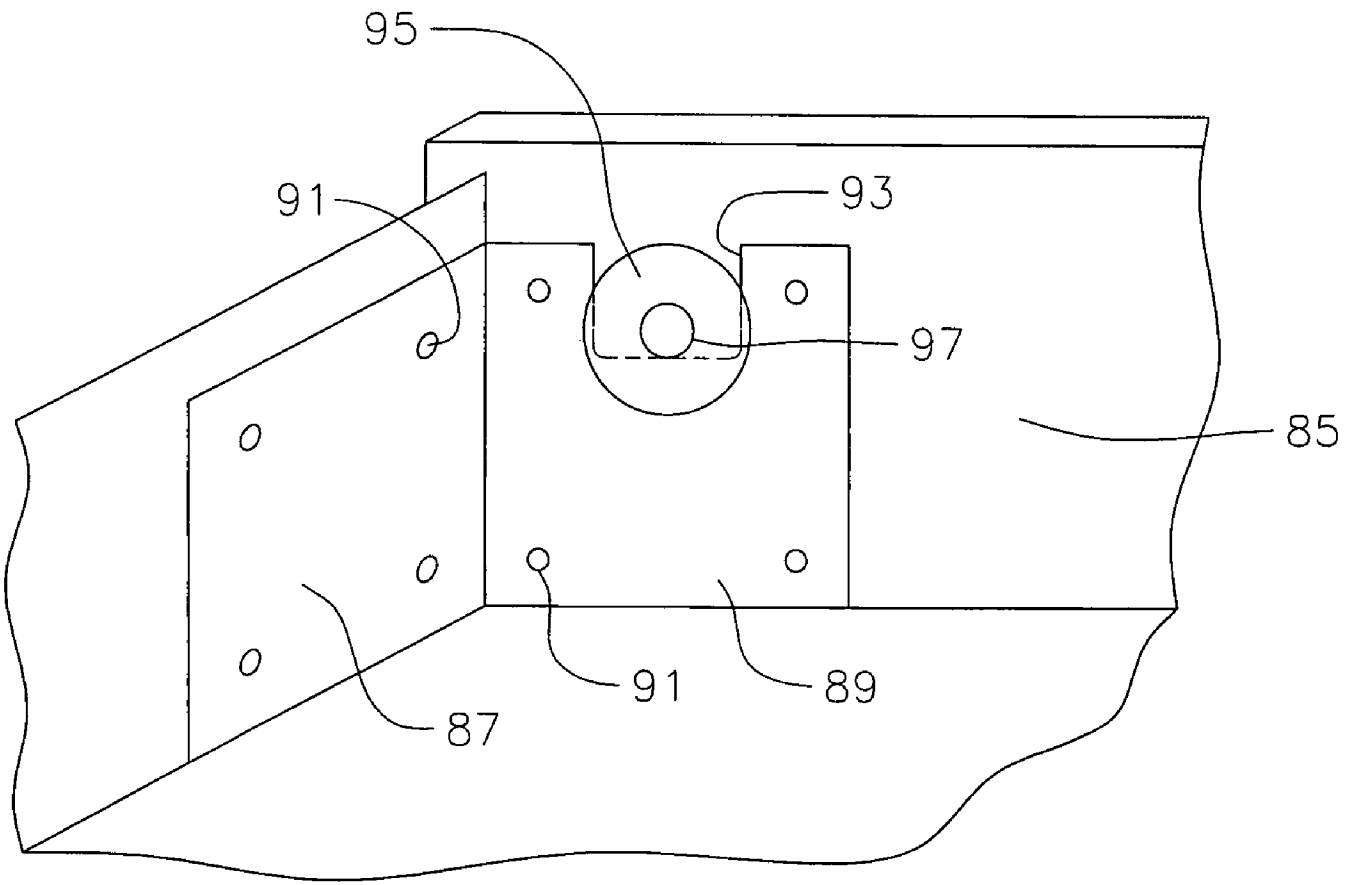
FIG. 8 illustrates a perspective view of a drawer including a drawer face and an adjuster in accordance with aspects of the invention.

FIG. 8 illustrates a further embodiment in accordance with aspects of the invention. In FIG. 8 an adjuster is used to allow for positioning of a drawer face with respect to a drawer. The drawer includes a bottom 83 and two opposing side walls approximate opposing margins of the bottom. Generally the drawer will include a rear wall (not shown). The drawer also includes a drawer face 85. In some embodiments the drawer may also include a drawer front, with the drawer face coupled in front of the drawer front. A drawer front may be provided, for example, to reduce the amount of material of the drawer face, which may be of higher quality, visually or otherwise, then the remainder of the drawer.

As illustrated in FIG. 8, an L-bracket is placed in one corner of the drawer, with one side 87 of the L-bracket abutting a side wall and one side 89 of the L-bracket abutting a front of the drawer. Generally an opposing L-bracket will be at another corner of the front of the drawer, placed about the opposing sidewall and the front of the drawer.

The L-bracket includes a number of screw holes 91 for fixing the side of the L-bracket to the side wall. The L-bracket also includes a cut-out 93 on the other side of the L-bracket. The cut-out extends to the edge of the L-bracket. In various embodiments, an aperture is used in place of the cut-out. An adjuster 95, a clamp as illustrated in FIG. 8, grips the L-bracket about edges of the cut-out. A screw hole 97 passes through the clamp. In operation, a screw is passed through the screw hole and into a drawer face. The drawer face is therefore is affixed to the adjuster. The adjuster is then moved within the cut-out until the drawer face is properly positioned with respect to the remaining portions of the drawer. Generally this operation will occur simultaneously or in sequence with use of another adjuster at another edge of the drawer face. In many applications this positioning may easily be accomplished by simply shutting the drawer, allowing alignment with the cabinet face or adjacent drawers to provide correct positioning of the drawer face. Once the drawer face is properly positioned, screws are placed through additional screw holes on the front face of the L-bracket, and the drawer face is securely positioned with respect to the remaining portions of the drawer.

Figure 9:
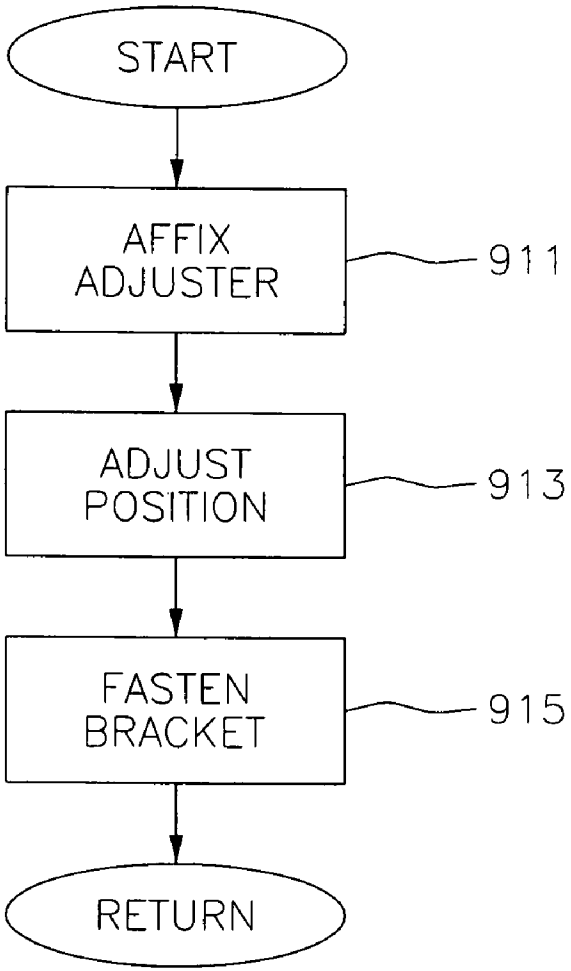
FIG. 9 is a flow chart of a process for use of the adjustable mounting bracket in accordance with aspects of the invention.

With reference to FIG. 9, a flow chart of a process for use of the adjustable mounting bracket is shown. In block 911, the adjuster is affixed to the drawer face or cabinet. The adjuster can be configured to receive a fastener or a screw through a hole in the adjuster. The fastener also engages the drawer face or cabinet to ensure the adjuster remains stationary thereto. In block 913, the position of the bracket is adjusted relative to the adjuster. The adjuster moves within the aperture of the bracket as force is applied to the bracket, causing the bracket to move into an adjusted position. This is often achieved by shutting and opening the drawer. The adjuster parts squeeze together on either side of the bracket, providing the friction necessary to keep the bracket in the adjusted position. In block 915, the bracket is fastened to the drawer face or cabinet through the mounting holes of the bracket. Various fasteners, for example screws, pass through the mounting holes and the drawer face or cabinet, thus securing the bracket in the adjusted position.

While the invention has been described in certain specific embodiments, it should be recognized that the invention is defined by the scope of claims and insubstantial variations thereof supported by this disclosure.

What is claimed:

1. A drawer assembly comprising:

a drawer slide assembly comprising a first slide member and a second slide member extendably coupled to one another;

a bracket having a window passing therethrough, wherein the bracket is configured for coupling to the second slide member; and a clamp adjustably gripping the bracket about the window, the clamp including a post extending through the window and occupying less than a majority of a vertical dimension of the window and a horizontal dimension of the window, the post being moveable within the window in vertical and horizontal directions, the vertical and horizontal directions being orthogonal to an axis defined by the post, wherein the clamp is configured for coupling to a vertical wall of the cabinet.

2. The drawer assembly of claim 1 wherein the clamp is configured to receive a fastener for coupling the clamp to the wall of the cabinet.

3. The drawer assembly of claim 1 wherein the bracket comprises a base and a wall extending perpendicular to the base.

4. The drawer assembly of claim 3 wherein the bracket further comprises a raised platform extending above the base.

5. The drawer assembly of claim 4 wherein a portion of the second slide member of the drawer slide assembly is positioned between the raised platform and the base of the bracket.

6. The drawer assembly of claim 1 wherein the bracket includes a base and a wall extending perpendicular to the base, with the window in the wall.

7. The drawer assembly of claim 6 wherein the base comprises a longitudinal sheet, with creases along margins of the longitudinal sheet.

8. The drawer assembly of claim 6 wherein the wall has offset portions toward margins of the wall.

9. The drawer assembly of claim 1, wherein the clamp comprises a disk having a post extending therefrom and a ring engaging the post, wherein the disk and the ring bear against opposite sides of the bracket.

10. A drawer slide assembly comprising:

a drawer slide comprising a first slide member and a second slide member extendably coupled to one another;

an L-shaped bracket coupled to the first slide member of the drawer slide, the L-shaped bracket including a base and a wall extending from a longitudinal end of the base, the wall including a central window and offset portions approximate margins of the wall, the offset portions including apertures for passage of screws; and means for adjusting the position of the bracket in a vertical direction and a horizontal direction by substantially the same amount within a plane defined by the wall.

11. A method for securing a drawer component to a cabinet component, comprising:

coupling the drawer component to a bracket;

mounting the bracket to the cabinet component with a clamp having a post and a resilient clamping ring mounted around the post, the clamping ring frictionally gripping the bracket about a first portion proximate an aperture of the bracket, the bracket being movable radially with respect to an axis defined by the post;

securing the clamp to the cabinet component;

moving the bracket relative to the cabinet component in at least one of a vertical direction and a horizontal direction to an adjusted position;

maintaining the bracket in the adjusted position by the resilient clamping ring frictionally gripping the bracket at the first portion; and securing a second portion of the bracket different from the first portion to the cabinet component using a fastener.

12. The method of claim 11, wherein the drawer component comprises a drawer slide, and wherein the cabinet component comprises a cabinet frame.

13. The drawer assembly of claim 6 wherein the post is a hollow cylinder, with a head at the end of the post, the head having an outer diameter greater than the post, and the clamp includes a female part positioned about the post, with the head holding the female part against the wall.

14. The drawer assembly of claim 13 wherein the female part is in the form of a ring, and the ring includes diametrical slots.

15. A drawer assembly comprising:

a drawer slide assembly comprising a first slide member and a second slide member extendably coupled to one another;

a bracket configured to mount the drawer slide assembly to a cabinet, the bracket having a window passing therethrough, wherein the bracket is configured for coupling to the second slide member;

a clamp comprising a post and a resilient clamping ring mounted around the post, the post extending through the window and moveable in the window in vertical and horizontal directions;

wherein the clamping ring frictionally engages the bracket about a first portion of the bracket proximate the window to maintain a position of the bracket relative to the post when the post is moved in the window in vertical and horizontal directions;

wherein the bracket further comprises a second portion different from the first portion for mounting the bracket to the cabinet.

* * * * *